United States Patent [19]

Rosenfeld et al.

[11] Patent Number: 5,055,150

[45] **Date of Patent: * Oct. 8, 1991**

[54] PROCESS AND APPARATUS FOR PRODUCING COATED POLYMER SHEETS HAVING OXYGEN AND MOISTURE BARRIER PROPERTIES AND COATED POLYMER SHEETS THUS PRODUCED

[75] Inventors: Aron M. Rosenfeld; Paul Smits, both of Kingston, Canada; Howard F. DeFerrari, Louisville, Ky.

[73] Assignee: Alcan International Limited, Montreal, Canada

[ * ] Notice: The portion of the term of this patent subsequent to Jun. 6, 2006 has been disclaimed.

[21] Appl. No.: 476,793

[22] Filed: Feb. 8, 1990

Related U.S. Application Data

[63] Continuation-in-part of Ser. No. 306,515, Feb. 3, 1989.

[51] Int. Cl.[5] ..... B44C 1/00

[52] U.S. Cl. ..... 156/150; 156/151; 156/233; 156/240; 204/38.3; 204/42

[58] Field of Search ..... 156/150, 151, 233, 240, 156/235; 204/38.3, 42; 428/40, 43, 914, 915

[56] References Cited

U.S. PATENT DOCUMENTS

| | | | |
|---|---|---|---|
| 841,321 | 1/1907 | Howard | 428/915 |
| 2,360,325 | 10/1944 | Higbee | 428/915 |
| 3,971,710 | 7/1976 | Romankiw . | |
| 4,082,573 | 4/1978 | Williams | 428/915 |
| 4,098,940 | 7/1978 | Groh et al. | 428/915 |
| 4,190,315 | 2/1980 | Brettle et al. | 428/469 |
| 4,322,466 | 3/1982 | Tomlinsen | 428/915 |
| 4,424,911 | 1/1984 | Resnick | 428/916 |
| 4,434,010 | 2/1984 | Ash . | |
| 4,473,422 | 9/1984 | Parker et al. | 156/233 |
| 4,480,760 | 11/1964 | Schonberger | 215/230 |
| 4,489,841 | 12/1984 | Thompson | 215/230 |
| 4,502,605 | 3/1985 | Wloszczyan | 215/230 |
| 4,511,052 | 4/1985 | Howard | 215/230 |
| 4,516,679 | 5/1985 | Simpson et al. | 428/916 |
| 4,519,515 | 5/1985 | Schonberger | 215/230 |
| 4,557,505 | 12/1985 | Schaefer et al. | 428/916 |
| 4,568,413 | 2/1986 | Toth et al. | 156/233 X |
| 4,591,062 | 5/1986 | Sandhaus | 215/230 |
| 4,662,653 | 5/1987 | Greenaway | 428/915 |
| 4,705,300 | 11/1987 | Benning et al. | 283/91 |
| 4,721,217 | 1/1988 | Phillips et al. | 283/91 |
| 4,837,061 | 6/1989 | Smits et al. | 428/915 X |

FOREIGN PATENT DOCUMENTS 0227423 7/1987 European Pat. Off. .

OTHER PUBLICATIONS

W. L. Baun, J. of Materials Science 15 (1980) 2749–2753, "Anodization of Evaporated Aluminium on Ti–6 wt % Al–4 wt % V".

A. E. Yaniv and I. E. Klein, Corrosion Science 1971, vol. 11, pp. 343–352—"Anodizing in Fluoroboric Acid Solution".

L. Young, 1957, Transactions Faraday Society, 58, 841.

W. E. Hillig, cited in D. A. Vermilyea, 1957, J. Electrochemical Society 104m 485.

(List continued on next page.)

*Primary Examiner*—David A. Simmons

*Assistant Examiner*—James J. Engel, Jr.

*Attorney, Agent, or Firm*—Cooper & Dunham

[57] ABSTRACT

A process for coating a polymer sheet with a transparent coating having moisture and oxygen barrier properties. The process starts with a metal substrate made of, or having a surface coating of, a valve metal or valve metal alloy. The metal substrate is anodized to form an anodic film of the valve metal on the metal substrate. The anodic film is made readily detachable from the metal by carrying out the anodization step in the presence of an adhesion-reducing agent, e.g. a fluoride. The polymer sheet, usually in the form of a thin transparent layer, is then attached to the anodic film and the anodic film is detached from the metal. The transferred anodic film forms a thin dense oxide coating on the polymer sheet that acts as a barrier against oxygen and moisture transport. The invention can be used for making packaging sheets suitable for packaging foodstuffs, and the like.

20 Claims, 5 Drawing Sheets

OTHER PUBLICATIONS

B. Maurel, D. Dieumegard and G. Amsel, 1972, J. Electrochemical Society 119, 1715.

A. Aladjem and D. G. Brandon, 1969, J. Vacuum Science and Technology 6, 635.

R. E. Pawel and T. S. Lundy, 1964, J. Applied Physics 35, 435.

R. E. Pawel, J. P. Pemsler and C. A. Evans, 1972, J. Electrochemical Society 119, 25.

The Optical Props of Thin Oxide Films on Ti; Charlesby et al., Proc. Royal Soc. 227 (1955), 434–443.

Anodizing Reactive Metals; Seely, Metal Finishing 8/1986.

Metallurgy of the Rarer Metals; G. L. Miller, Butterworth, Sci. Publ. London, 1959.

Pawel & Lundy—A Submicron Sectioning Technique for Analyzing Diffusion Specimens of Tantalum and Niobium—J. of Applied Physics—Feb. 1961.

Young—Anodic Oxide Films—Sep. 1956.

PROCESS AND APPARATUS FOR PRODUCING COATED POLYMER SHEETS HAVING OXYGEN AND MOISTURE BARRIER PROPERTIES AND COATED POLYMER SHEETS THUS PRODUCED

CROSS-REFERENCE TO RELATED APPLICATIONS

This application is a continuation-in-part of our prior application Ser. No. 306,515 filed on Feb. 3, 1989.

BACKGROUND OF THE INVENTION

I. Field of the Invention

This invention relates to the formation of coated polymer sheets having good oxygen and moisture barrier properties suitable for use as packaging materials for foodstuffs and the like. More particularly, the invention relates to a process for producing such materials involving the application, of barrier layers to polymer sheets preferably made of transparent plastic. The invention also relates to the coated sheets thus formed and to apparatus used for the process.

II. Description of the Prior Art

Plastic packaging sheets used in the food industry are normally made moisture and oxygen impermeable by coating the plastic sheets on one side with a relatively thick layer of aluminum. The resulting sheet is opaque, so that food contents cannot be seen, and the sheets cannot be used in microwave ovens because of undesirable shorting and reflections caused by the metal layer.

There is a need for transparent, microwavable packaging sheets having the required barrier properties. While multi-layer plastic laminates can be used to reduce the oxygen and water vapour transmission characteristics of packaging materials, satisfactory structures are very expensive and often require as many as six different polymer layers (see Modern Plastics, August 1986, pp 54–56).

In recent years, a different approach to the problem has consisted of vacuum depositing thin films of inorganic coatings onto flexible transparent polymer laminates (see, for example, U.S. Pat. No. 4,702,963 issued on Oct. 27, 1987 to Optical Coating Laboratory Inc. and Japanese Patent Application 60 46,363). A recent article in Paper, Film and Foil Converter, June 1988, pp 102–104, describes the deposition of transparent silica barrier coatings on plastic films via electron beam technology. It is apparent that complex and expensive equipment has to be utilized to deposit such barrier coatings onto plastic substrates and that the resulting coatings may be subject to cracking upon flexing of the film. Furthermore, the silica type films used in the process exhibit a yellowish discolouration when laminated with transparent flexible polymer films for use in packaging, and this discolouration makes many food contents look unappealing. Finally, materials deposited by electron beam techniques are typically less dense than the bulk form of the coating material and so the barrier properties are not optimal.

Non-porous oxide films produced on certain valve metals by anodization are denser than similar materials deposited by electron beam techniques or other types of deposition. However, such films cannot be easily separated over large areas from the metal on which they are formed. Dissolving away the underlying metal base by chemical means would be a possible approach, but would be highly uneconomical and cumbersome and would be difficult to achieve without the oxides themselves being subject to inadvertent dissolution by such means.

An object of the invention is therefore to provide a process for producing a coated polymer sheet having good oxygen and moisture characteristics.

Another object of the invention is to provide a packaging material with a transparent dense anodic oxide coating capable of acting as an oxygen and moisture barrier.

Yet another object of the invention is to provide a packing film with a dense coating of a valve metal oxide.

SUMMARY OF THE INVENTION

The invention, at least in its broadest form, is based on the finding anodic films can be transferred to plastic sheets in an economical and reliable manner if certain materials are used during the anodization of certain metals.

More particularly, the invention provides a process for coating a polymer film with a transparent moisture and oxygen barrier coating, which process comprises: providing a metal substrate made of a valve metal or an anodizable valve metal alloy, at least at an exposed surface of the substrate; an anodic film of valve metal oxide on said metal substrate, said anodization being carried out in the presence of an adhesion-reducing agent capable of making said anodic film readily detachable from said metal substrate; attaching said polymer sheet to said anodic film; and detaching said anodic film and attached polymer sheet from said metal substrate.

The invention also relates to coated polymer sheet produced by the process and to apparatus for operating the process.

DETAILED DESCRIPTION OF THE PREFERRED EMBODIMENTS

Figure 1A:
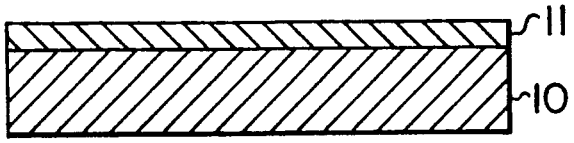
FIGS. 1(A)–(E) show cross-sections of intermediate and final products produced by a preferred process according to the invention.

In the present invention, the anodic film is first formed on a metal substrate and is then transferred to a polymer sheet, in order to form a dense oxygen- and moisture-impermeable surface barrier coating on the polymer sheet. The anodic film is formed by subjecting a valve metal or valve metal alloy to a conventional barrier layer anodization process in a suitable electrolyte. The techniques of anodizing valve metals to form barrier oxide films are well known to persons skilled in the art, e.g. as described by L. Young in "Anodic Oxide Films" 1961, Academic Press, the disclosure of which is incorporated herein by reference.

The valve metals are metals such as Ta, Nb, Zr, Hf, Ti, etc., which can be anodized to form a dense oxide layer having a maximum thickness dependent on the voltage used for the anodization step, with thicker films being formed at higher voltages. The most preferred valve metal for use in the present invention is Ta because it forms a particularly dense and flexible oxide which is especially suitable for the intended purpose (see S. F. Bubar and D. A. Vermilyea, J. Electrochem. Soc. 113 (1966) 892 and ibid 114 (1967) 882). Anodic films which have effective moisture and oxygen barrier properties when transferred to packing materials are usually those formed at voltages in the range of 30–300 V, although lower voltages may be employed if particularly thin (and consequently very flexible) films are required. The anodization takes place very quickly, normally requiring only seconds or minutes, and the procedure is generally carried out at ambient temperature.

Since valve metals are usually quite expensive, the metal substrate is normally made up of a foil, sheet or plate of an inexpensive co-anodizable metal (e.g. aluminum) having a thin coating of the valve metal on one surface. The valve metal layer can be formed by any suitable technique, but vapour deposition techniques, such as chemical vapour deposition or physical vapour deposition, are particularly preferred because the characteristics of the resulting valve metal layer make subsequent separation of the anodic film highly reliable over large areas. Sputtering and vacuum evaporation are the most preferred techniques. The deposited layer of valve metal need only be very thin, although the thickness should be great enough to avoid complete consumption of the metal during anodization. Generally, the thickness of the metal should be at least 250 Å. As an example, a 300 Å coating of Ta can be deposited on an aluminum foil at speeds in the order of 50 feet per minute by a sputtering process. If desired, however, the metal substrate may be made entirely of the valve metal or alloy in the form of a foil, sheet, plate etc. This becomes economical if the valve metal is used repeatedly as a substrate for the film formation.

As noted above, anodization is carried out in the presence of an adhesion-reducing agent which has the effect of weakening the bond between the anodic film as it grows and the underlying valve metal. The most preferred adhesion-reducing agent is fluoride (fluorine ions) which may be in the form of a simple salt, e.g. NaF or KF, or in the form of complex salts, fluorine-containing compounds or acids, e.g. hydrofluoric acid or fluoroboric acid. The compound may be added to the electrolyte or coated on the surface of the valve metal prior to the anodization step. Generally, quite small amounts of the adhesion-reducing agent are required; for example, when the agent is a fluoride, the amount can be as low as about 0.003% by volume (more preferably at least 0.05% by volume) of the electrolyte. However, the desired levels in any particular case can be determined by simple trial and experimentation.

Following the anodization step, after suitable rinsing to remove the electrolyte and suitable drying to remove residual moisture, the polymer sheet is attached to the outer surface of the anodic film. The polymer sheet can be made of any one of a variety of materials but is preferably a thin flat layer of transparent polymeric packing material intended for use in the food packaging industry. The attachment may be indirect, e.g. via a layer of an adhesive, glue etc., or direct when the nature of the polymer sheet permits, e.g. polymers such as polyester and polypropylene that may be directly heat sealed to the anodic film. A particularly suitable adhesive for attaching the polymer sheet to the anodic film is UV-curable adhesive (e.g. Norland Optical Adhesive) because such adhesives tend to be very transparent when cured and because the curing step (exposure to ultraviolet light) is quick and effective.

Once the polymer sheet has been attached to the anodic film, the anodic film is detached from the metal substrate. This is most easily achieved by peeling the anodic film and attached polymer sheet gradually from the metal substrate, or alternatively gradually peeling the metal substrate from the anodic film and polymer sheet, depending upon which is the more flexible. By making the metal substrate thin and flexible and the polymer sheet less flexible, the anodic film can be held flat by the polymer sheet during the peeling step, which further helps to prevent any cracking of or damage to the anodic film.

The resulting structure comprises a sheet of the polymer having a coating of an anodic film on one surface. This basic structure can, however, be added to in a variety of ways, e.g. by repeating the anodization process and adhering a second anodic film over the first to further reduce oxygen and moisture permeability of the polymer film. Further alternatives are provided in the more detailed description given below in which reference is made to the drawings.

The accompanying drawings show various steps in a preferred form of the process and equipment which can be used to carry out the process.

Figure 1B:
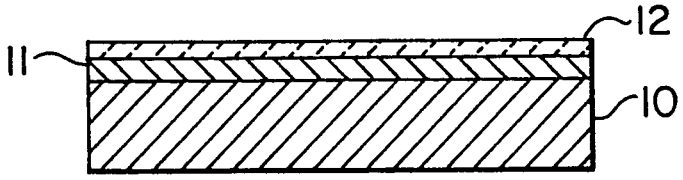
Figure 1C:
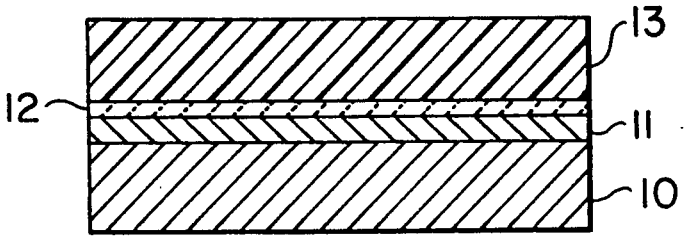
Figure 1D:
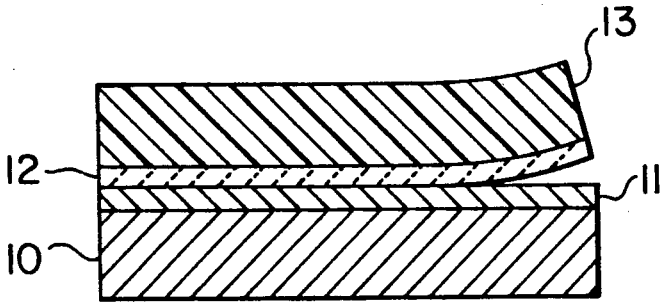
Figure 1E:
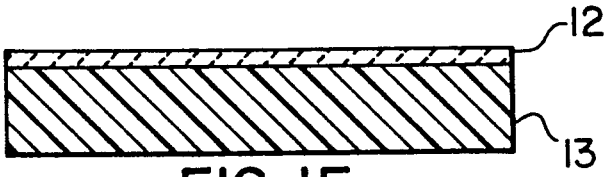

FIG. 1A shows a metal substrate comprising an aluminum foil 10 and a thin coating 11 of Ta, preferably sputtered onto the foil. FIG. 1B shows the same structure following anodization of the Ta in an electrolyte containing an adhesion reducing agent, e.g. NaF. A detachable anodic film 12 is formed on the Ta surface. In FIG. 1C, a polymer sheet 13 has been attached to the anodic film 12. In FIG. 1D, the polymer sheet 13 and anodic film 12 are peeled from the metal substrate. FIG. 1E shows the polymer sheet 13, after inversion, having a surface coating 12 of dense anodic $Ta_2O_5$ acting as a moisture and oxygen barrier.

Figure 2:
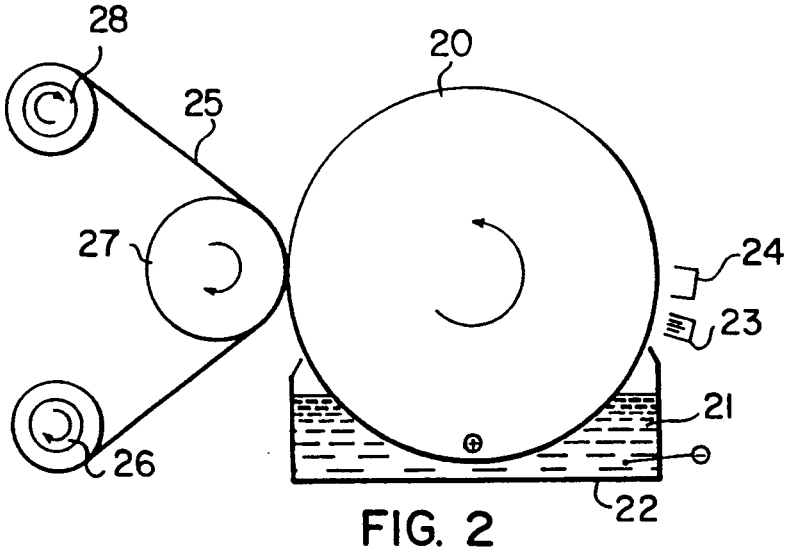
FIGS. 2 and 3 are schematic representations of apparatus for carrying out preferred processes according to the present invention on a continuous basis.

FIG. 2 shows apparatus for producing the coated polymer sheet of FIG. 1E on a continuous basis. Drum 20 is made of, or has a surface coating of, tantalum. The drum is rotated slowly in the direction of the arrow.

An electrolyte 21 (which includes an adhesion-reducing agent, e.g. NaF) is contained in a bath 22 positioned so that the lower section of the drum 20 dips into the electrolyte and anodization of the Ta at the surface of the drum takes place. A washing station 23 washes the drum as it emerges from the bath and a drying station 24 dries it. A heat-sealable polymer sheet 25, fed off a payoff roll 28, is pressed against the drum by heated transfer roller 27. The polymer sheet 25 adheres to the anodic film on the drum and the anodic film transfers from the drum to the polymer sheet. The coated polymer sheet is then wound onto take-up roll 26.

Figure 3:
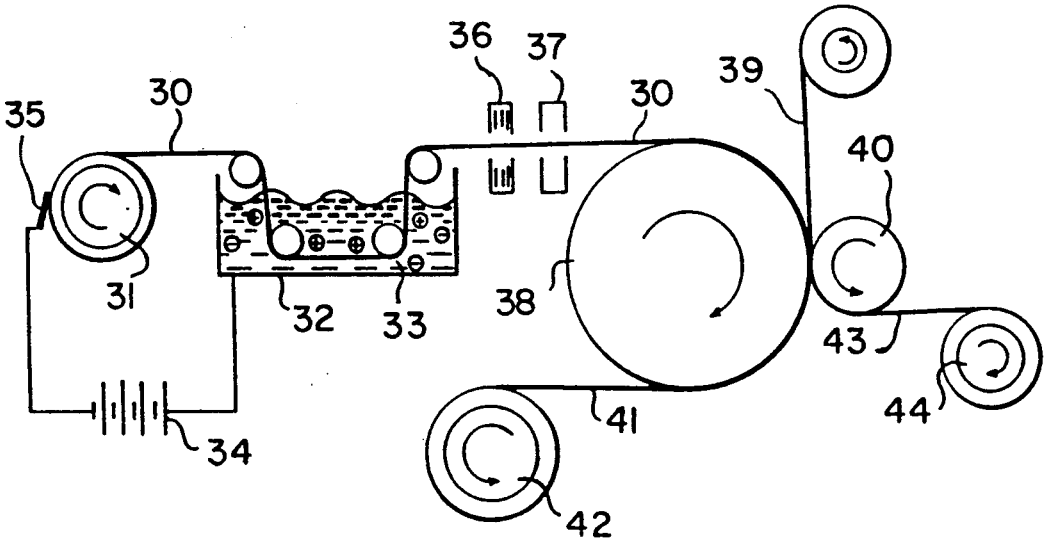

FIG. 3 shows alternative apparatus for producing a coated packaging sheet on a continuous basis. Foil 30, made of tantalum (e.g. 0.020 inch thick) or aluminum coated on one side with tantalum, is fed from pay-off roll 31 and is immersed by a series of rollers in an electrolysis tank 32 containing an electrolyte 33 suitable for anodization. Anodization of the foil takes place by virtue of the current flowing from battery 34 to the foil 30 (via sliding contact 35), through the electrolyte 33 and back to the battery via the tank 32. Following the anodization, the foil emerges from tank 32 and is rinsed at station 36 and dried at station 37. The foil then passes around a heated drum 38 where it contacts a heat-sealable packaging sheet 39 under the pressure of a chill roll 40. In the nip between the drum 38 and roll 40, the anodic film formed on the tantalum surface of the foil 30 is stripped off the foil and transferred to the sheet 39. The stripped foil 41 is wound up on take-up roll 42 ready for reuse. The coated packaging sheet 43 is collected on take up roll 44.

More complicated structures can be produced by building upon the basic structure of FIG. 1E in order to improve the oxygen and moisture barrier capabilities even further. Examples of such structures are shown in FIGS. 4, 5 and 6.

Figure 4:
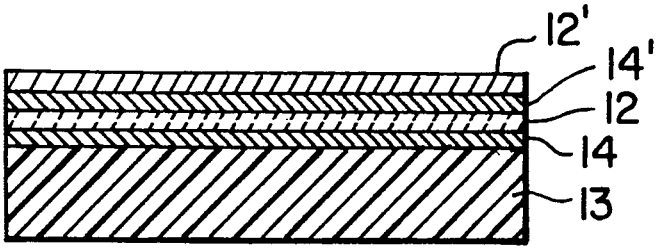
FIGS. 4, 5 and 6 are cross-sections of additional polymer film structures according to further aspects of the invention.

FIG. 4 shows a structure in which a polymer packaging sheet 13 is provided with two layers of oxide 12 and 12' on one surface. A structure of this type can be formed by first forming the structure of FIG. 1E. In this case, a layer of adhesive 14 was used to adhere the packaging sheet 13 to the oxide film 12 prior to the removal of the oxide film from the valve metal, and this layer remains in the resulting packaging structure as shown. After removal of the oxide film 12 from the underlying valve metal, the valve metal is again anodized and a further layer of adhesive 14' is coated on the resulting oxide film 12'. The previously coated packaging sheet is then attached to the oxide film 12' via the adhesive layer 14' and the oxide film 12' is peeled from the valve metal. The resulting structure is then as shown in FIG. 4.

Figure 5:
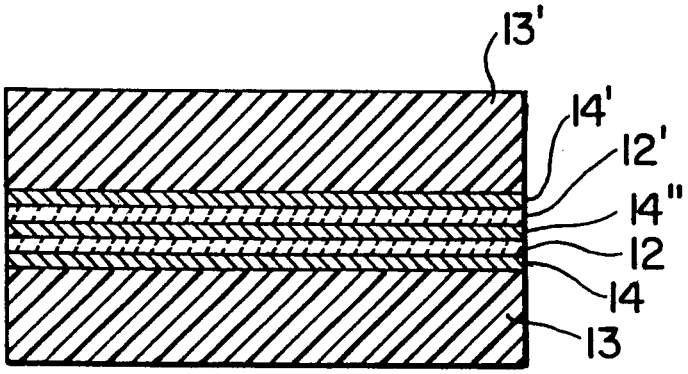

The structure shown in FIG. 5 has two layers of polymer sheet 13 and 13' joined together via two oxide films 12 and 12' and three adhesive layers 14, 14' and 14''. This structure is formed by first producing two structures of the type shown in FIG. 1E (again with an adhesive layer between the polymer sheet and the oxide film), and then adhering the two structures together with the oxide films facing each other via a further adhesive layer 14''.

Figure 6:
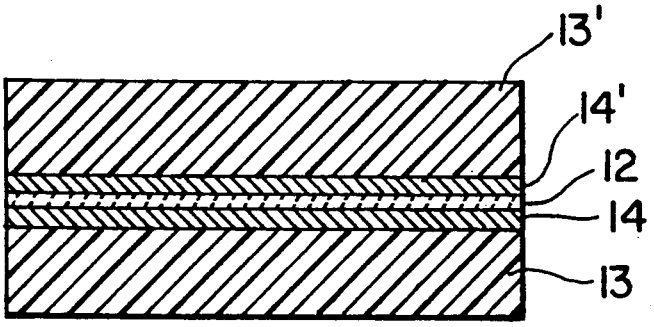
Figure 7A:
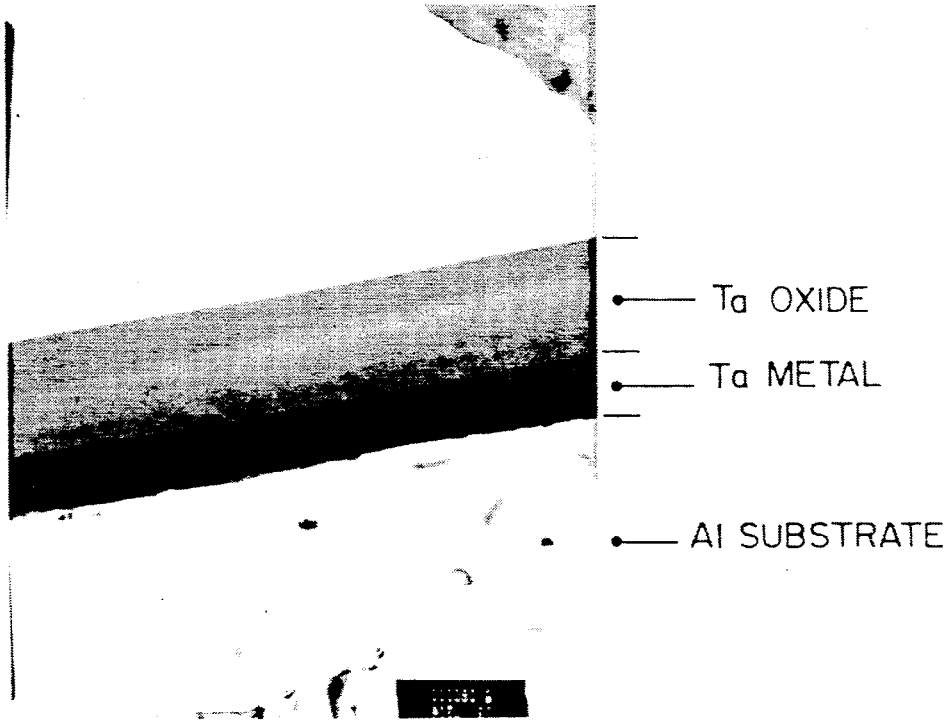
FIGS. 7(A)–(C) are photomicrographs of intermediates and the product formed in Example 1 below.
Figure 7B:
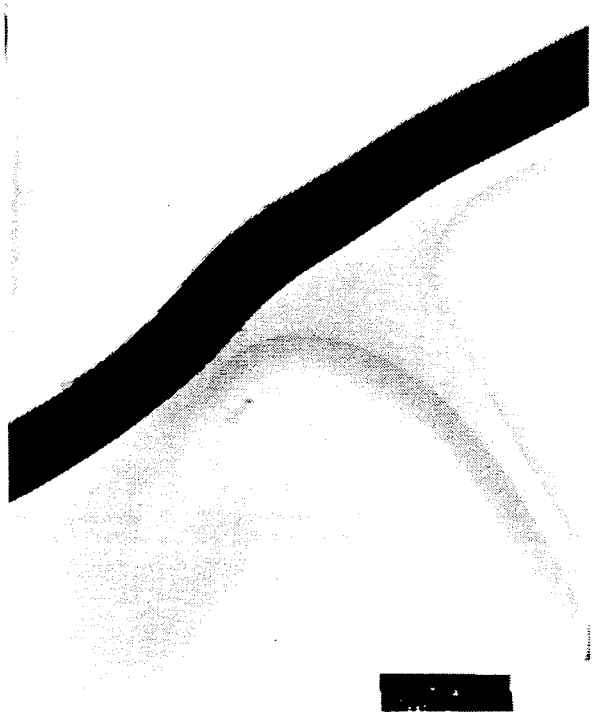
Figure 7C:
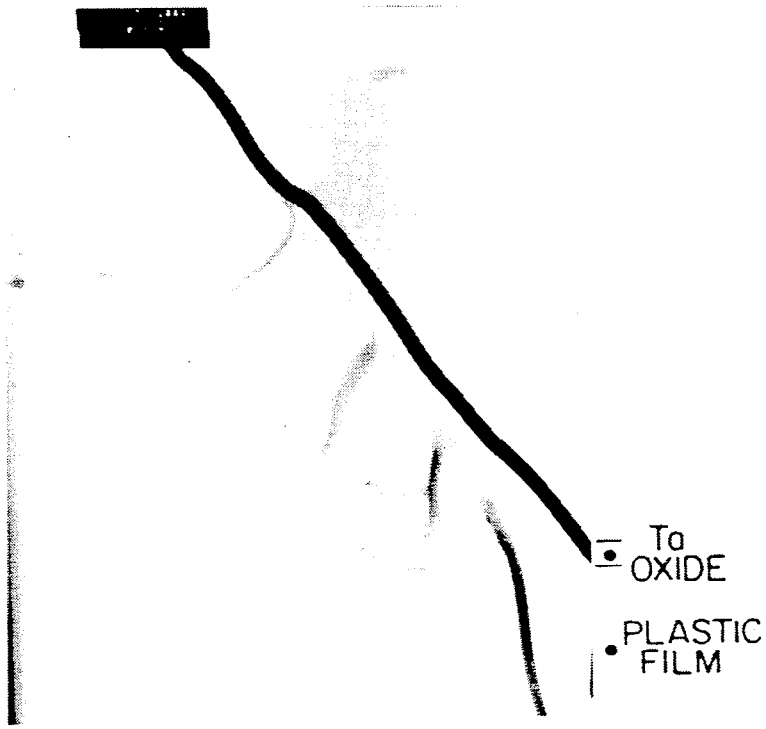

The structure of FIG. 6 has two layers of polymer sheet 13 and 13' attached via a single oxide film 12 and two adhesive layers 14 and 14'. This structure is formed by first forming a structure of the type shown in FIG. 1E (with an adhesive layer 14) and then attaching a further layer of polymer sheet to the oxide film 12 via a further layer of adhesive 14'.

Clearly further structures could be formed by similar techniques.

The following non-limiting Examples provide further illustration of the invention.

EXAMPLE 1

Tantalum was sputtered onto aluminum foil in a commercial planar magnetron sputtering unit, at a power density of 5 watt/cm$^2$ and pressure of 10 mtorr to a thickness of 1,500 Å. The coated foil was then anodized in 0.4 M phosphoric acid, doped with 0.05% hydrofluoric acid by volume, to a forming voltage of 90 V resulting in a Ta oxide anodic film thickness of 1500 Å and leaving a residual layer of Ta metal 915 Å thick. The anodized foil was then heat-sealed to polyethylene laminated polyester sheet, in a commercial heat seal apparatus, at a temperature of 150° C. The foil was then peeled away from the plastic sheet, transferring the Ta oxide layer to it as a coating.

The structures resulting from this process are illustrated in the cross-sectional transmission electron micrographs 7(A), (B) and (C) taken at magnifications of 80,000×, 60,000× and 13,000× respectively. The intermediate and final structures are shown in FIG. 4.

Micrograph *7a* shows the as-anodized, Ta sputtered aluminum foil, which is slightly under-exposed to reveal the dense, homogeneous and amorphous Ta anodic film. At normal exposure, the layer would appear very dark due to the very large electron absorption of the dense oxide (as does the even denser Ta metal layer in the underexposed micrograph 4*a*).

Micrograph *7b* shows the Ta oxide film transferred to the packaging sheet, which is slightly over-exposed to reveal the normally electron transparent organic substrate.

Micrograph *7c* is a further magnification of micrograph 4*b* to illustrate the uniformity and crack or pore free nature of the transferred oxide over a larger area.

EXAMPLE 2

Tantalum metal was sputtered onto super-bright aluminum foil to a thickness of 3000 Å. The sputtered film was then anodized to form Ta oxide in 50 g/l citric acid. Fluorine was added to the electrolyte to reduce adhesion between the resulting Ta oxide and the remaining Ta metal. The anodizing voltage was selected from the range 50–200 V, depending on the thickness of the oxide desired.

Norland Optical Adhesive (type 61) was applied to the surface of the anodized foil and a polymer sheet of Melinex (biaxially orientated polyester −5 mil) was placed over the adhesive and a draw-down bar was used to distribute the adhesive uniformly over the surface of the foil.

The adhesive was cured by directing ultraviolet light through the laminated structure and the oxide was then transferred to the polymer sheet by peeling away the aluminum foil. A structure of the type shown in FIG. 4 was also formed by duplicating the oxide film on one side of the sheet.

Table 1 below lists steady state values of oxygen transmission through the uncoated polymer and through the polymer coated as above. A MOCON Oxtran 100A tester was used to obtain the results at 25° C. and 0% relative humidity.

TABLE 1

| SHEET TYPE | OXYGEN TRANSMISSION (cc/m$^2$/day) RANGE | AVERAGE |
|---|---|---|
| Melinex, 120 μm | 14.9–18.1 | 16.4 |
| Melinex/UV adhesive | 11.9–12.9 | 12.4 |
| Melinex/adh/1800 Å TaOx | 0.6–2.9 | 1.8 |
| Melinex/adh/1800 Å TaOx/adh/1800 Å TaOx | 0.06 | 0.06 |

The considerable reduction of oxygen transmission obtainable by the present invention is apparent from the figures in the Table.

What we claim is:

1. A process for providing a polymer sheet other than a packaging film with a coating having moisture and oxygen barrier properties, which process comprises:

providing a metal substrate comprising a valve metal or an anodizable valve metal alloy, at least at an exposed surface of said substrate;

anodizing said metal substrate at said exposed surface to form an anodic film of valve metal oxide on said metal substrate, said anodization being carried out in the presence of an adhesion-reducing agent capable of making said anodic film readily detachable from said metal substrate;

attaching a polymer sheet other than a packaging film to said anodic film; and detaching said anodic film and attached polymer sheet from said metal substrate to form a coated polymer sheet.

2. A process according to claim 1 wherein said polymer sheet is a thin flexible transparent film made of an organic polymer.

3. A process according to claim 1 wherein said valve metal is Ta, Nb, Zr, Hf or Ti.

4. A process according to claim 1 wherein said valve metal is tantalum.

5. A process according to claim 1 wherein said metal substrate consists solely of said valve metal.

6. A process for providing a polymer sheet with a coating having moisture and oxygen barrier properties, which process comprises:

providing a metal substrate comprising a layer of a valve metal supported on another material, said valve metal forming an exposed surface of said substrate;

anodizing said substrate at said exposed surface to form an anodic film of valve metal oxide on said metal substrate, said anodization being carried out in the presence of an adhesion-reducing agent capable of making said anodic film readily detachable from said metal substrate;

attaching a polymer sheet to said anodic film; and detaching said anodic film and attached polymer sheet from said metal substrate to form a coated polymer sheet.

7. A process according to claim 6 wherein said layer of valve metal is applied to said another material by a vapour deposition technique.

8. A process according to claim 7 wherein said vapour deposition technique comprises sputtering.

9. A process according to claim 1, wherein said adhesion-reducing agent is a fluoride.

10. A process according to claim 1, wherein said adhesion-reducing agent is a simple or complex fluorine-containing salt, a fluorine-containing compound or a fluorine-containing acid.

11. A process according to claim 1, wherein said adhesion-reducing agent is present in an electrolyte used for said anodization step.

12. A process according to claim 11 wherein the adhesion-reducing agent is a fluoride and said fluoride is present in an amount of at least 0.003% by volume of the electrolyte.

13. A process according to claim 1, wherein said polymer sheet is attached to said anodic film by means of an adhesive.

14. A process according to claim 1, wherein said polymer sheet is a heat-sealable plastic and wherein said plastic is attached to said anodic film by heat sealing.

15. A process for providing a polymer sheet with a coating having moisture and oxygen barrier properties, which process comprises:

providing a metal substrate comprising a valve metal or an anodizable valve metal alloy, at least at an exposed surface of said substrate;

anodizing said metal substrate at said exposed surface to form an anodic film of valve metal oxide on said metal substrate, said anodization being carried out in the presence of an adhesion-reducing agent capable of making said anodic film readily detachable from said metal substrate;

attaching a polymer sheet to said anodic film;

detaching said anodic film and attached polymer sheet from said metal substrate to form a coated polymer sheet; anodizing a metal substrate comprising a valve metal or valve metal alloy, at least at an exposed surface thereof, to cause an additional anodic film to grow on said metal substrate, said anodization being carried out in the presence of an adhesion-reducing agent capable of making said additional anodic film detachable from said metal substrate on which it is grown, attaching said coated polymer sheet to said additional anodic film, and detaching said additional anodic film and attached coated polymer sheet from said metal substrate on which the additional anodic film was grown to form a doubly coated polymer sheet.

16. A process according to claim 15 wherein said coated polymer sheet is attached to said additional anodic film such that the anodic film of the coated polymer sheet and the additional anodic film are adjacent in the doubly coated polymer sheet.

17. A process for providing a polymer sheet with a coating having moisture and oxygen barrier properties, which process comprises:

providing a metal substrate comprising a valve metal or an anodizable valve metal alloy, at least at an exposed surface of said substrate;

anodizing said metal substrate at said exposed surface to form an anodic film of valve metal oxide on said metal substrate, said anodization being carried out in the presence of an adhesion-reducing agent capable of making said anodic film readily detachable from said metal substrate;

attaching a polymer sheet to said anodic film;

detaching said anodic film and attached polymer sheet from said metal substrate to form a coated polymer sheet; repeating said process to form first and second coated polymer sheets; and adhering said first and second coated polymer sheets together.

18. A process according to claim 17 wherein said first and second coated polymer sheets are adhered together with the anodic film of each of said coated polymer sheets positioned adjacent to each other.

19. A process for providing a polymer sheet with a coating having moisture and oxygen barrier properties, which process comprises:

providing a metal substrate comprising a valve metal or an anodizable valve metal alloy, at least at an exposed surface of said substrate;

anodizing said metal substrate at said exposed surface to form an anodic film of valve metal oxide on said metal substrate, said anodization being carried out in the presence of an adhesion-reducing agent capable of making said anodic film readily detachable from said metal substrate;

attaching a polymer sheet to said anodic film;

detaching said anodic film and attached polymer sheet from said metal substrate to form a coated polymer sheet; and covering the anodic film of said coated polymer sheet by attaching a layer of an additional polymer sheet thereto.

20. A process according to claim 19 wherein said polymer sheet and said additional polymer sheet are made of the same material.

* * * * *